United States Patent [19]

Mills

[11] Patent Number: 4,660,890

[45] Date of Patent: Apr. 28, 1987

[54] ROTATABLE CUTTING BIT SHIELD

[76] Inventor: Ronald D. Mills, 960 S. Jay Cir., Anaheim, Calif. 92807

[21] Appl. No.: 762,928

[22] Filed: Aug. 6, 1985

[51] Int. Cl.[4] ..... E21C 25/12; E21C 35/18

[52] U.S. Cl. ..... 299/79; 299/86; 29/520

[58] Field of Search ..... 299/79, 86, 91-93; 175/412, 413; 37/141 T, 142 R; 29/515, 520

[56] References Cited

U.S. PATENT DOCUMENTS

| | | | |
|---|---|---|---|
| 3,331,637 | 7/1967 | Krekeler | 299/92 |
| 3,342,531 | 9/1967 | Krekeler | 175/413 |
| 3,512,838 | 5/1970 | Kniff . | |
| 3,746,396 | 7/1973 | Radd | 299/10 |
| 3,778,112 | 12/1973 | Krekeler | 299/86 |
| 3,841,708 | 10/1974 | Kniff et al. | 299/86 |
| 4,201,421 | 5/1980 | Den Besten | 299/86 |
| 4,470,210 | 9/1984 | Hahn | 37/142 R |
| 4,489,986 | 12/1984 | Dziak . | |
| 4,561,698 | 12/1985 | Beebe | 299/86 |

FOREIGN PATENT DOCUMENTS

| | | | |
|---|---|---|---|
| 2855288 | 7/1980 | Fed. Rep. of Germany | 29/520 |
| 2855577 | 7/1980 | Fed. Rep. of Germany | 175/413 |
| 2029761 | 3/1980 | United Kingdom | 299/92 |

*Primary Examiner*—Stephen J. Novosad
*Assistant Examiner*—Michael A. Goodwin
*Attorney, Agent, or Firm*—William L. Chapin

[57] ABSTRACT

A rotatable cutting bit shield and method and apparatus for attaching the shield onto cylindrical cutting bit shafts uses an annular metal ring having the shape of an inverted dish, and a centrally located hole through the ring. The diameter of the hole is initially larger than the diameter of the cutting bit shank. Compressive pressure exerted on the annular upper and lower faces of the ring by the apparatus according to the method causes the ring to deform into a flatter, more disc-shaped structure. This deformation causes the diameter of the central hole in the ring to shrink, captivating the ring axially between larger diameter annular flanges on the cutting bit shank.

5 Claims, 8 Drawing Figures

ROTATABLE CUTTING BIT SHIELD

BACKGROUND OF THE INVENTION

1. Field of the Invention

This invention relates to an article for improving the efficiency of operation of carbide-tipped cutting bits utilized in rotary machines adapted for pulverizing concrete and asphalt roadways and similar surfaces. More particularly, the invention relates to articles for improving the cutting action of rotatable carbide bits, and for protecting the support blocks in which the bits are mounted. Additionally, the invention relates to methods and apparatus for fastening ring-shaped cutting bit shields to the cylindrical shanks of cutting bits.

2. Description of Background Art

When concrete or asphalt roadways, aircraft runways, and the like require replacement or removal, a machine frequently employed for this purpose is a rotary pulverizer. Typically, the pulverizer utilizes a large drum which has a diameter of between two and three feet, and a length of six to twelve feet. Welded to the circumferential surface of the drum are 100–300 or more uniformly spaced, forged steel holding blocks which hold cylindrical, carbide-tipped cutting bits. The cutting bits extend radially outward from the drum. A typical rotary pulverizer drum is rotated by a 400 horsepower motor at a linear speed of 1,500 surface feet per minute.

The cutting bits used in many rotary pulverizers are elongated, solid cylinders, approximately $3\frac{1}{2}''$ long by $\frac{3}{4}''$ in diameter. The outer or top face of the cylinder typically has a conical-shaped carbide top brazed to it. Each cutting bit is held in a forged steel holding block welded to the circumference of the pulverizer drum. Approximately one-half of the length of the bit extends outward from the top face of the holding block. Each cutting bit is secured in its holding block with a clip or sleeve that permits the bit to rotate freely about its cylindrical axis. This permits the bit to be rotated by tangential frictional contact with the material which it is used to cut. As a result of rotation of the bit, wear of the bit is more evenly distributed, extending the useful life of the bit. U.S. Pat. No. 4,201,421 discloses a split sleeve for rotatably mounting cutting bits in their holding blocks.

Although providing the capability for free rotation of the cutting bit results in more uniform wear and extended life of the bit, wear of the bit holding block continued to be a problem. The flat, upper face of the bit holding blocks is continuously impacted with abrasive materials during the operation of the rotary pulverizers. Also, if a bit wears down to the extent that it extends only a short distance out from the face of its holding block, more rapid and destructive wear of the holding block occurs. Excessive wear of the bit holding block requires that the worn blocks be removed from the pulverizer drum with a cutting torch, and a new block welded onto the drum. This is a time consuming and therefore costly operation. Furthermore, it frequently happens that replacement of holding blocks under field conditions results in a misalignment of the bore axis of the mounting block from its optimum orientation.

To alleviate the problem of cutting bit holding block wear, I introduced in October of 1983 an accessory which I referred to as the "Spin Shield." This accessory is comprised essentially of a flat, hardened steel annular ring or washer which is adapted to fitting between the enlarged base of a cylindrical cutting bit, and the transverse outer face of the holding block which rotatably supports the bit. In addition to absorbing wear which would otherwise be experienced by the bit holding block, my "Spin Shield" provided other advantages. One such advantage is the separation between the cutting bit chamfer from the bit holding block, preventing the formation of a burr on the inside of the bore of the holding block. Another advantage is the reduction of cutting bit friction, allowing the cutting bit to rotate more freely. This results in cooler operation and more even wear of the cutting bit, substantially extending its life.

Subsequent to my introduction of the "Spin Shield" bit holding block protector, I observed in the field a cutting bit with an integral flange near the middle of the forged bit shank. The apparent purpose of the flange was to achieve in a limited way some of the advantages of my "Spin Shield."

In my U.S. patent application Ser. No. 06/677,235 filed Dec. 4, 1984, I disclosed a "Pulverizer Cutting Bit Shield" to protect holding blocks for cylindrical cutting bits from excessive wear. The cutting bit shield disclosed in that application comprised an annular steel ring shaped like an inverted dish with a central hole and a substantially curved, convex upper surface. The ring is adapted to being attached coaxially over the cylindrical shank of a cylindrical cutting bit by inserting the upper portion of the cutting bit into the bottom entrance of the central hole. The upper surface of the ring is then pounded down on the shank until it abuts an upper annular flange on the shank of the bit, and is retained in position by a tight interference fit between the outer diameter of the shank and the inner diameter of the ring.

The pulverizer cutting bit shield disclosed in my above-referenced patent application provides an effective means for protecting cutting bit holding blocks from excessive wear. Moreover, the rotation of the pulverizer cutting bit in unison with the shield fixed to its shank is particularly effective in applications where it is desired to mix material such as soil impacted by the cutting bit.

However, I have found that for some applications of pulverizer cutting bits, it would be desirable to have a freely rotatable cutting bit shield. In particular, for those applications of pulverizer cutting bits in which high impacts and/or highly abrasive materials are encountered, a freely rotating bit shield would be better because normal wear is distributed evenly on the cutting bit, thereby extending the useful life of the bit.

The present invention is responsive to the need for an accessory for cylindrical pulverizer cutting bits which affords protection for the holding block in which the bit is mounted, and which is also freely rotatable with respect to the shank of the cutting bit.

OBJECTS OF THE INVENTION

An object of the present invention is to provide an accessory which protects holding blocks in which cylindrical cutting bits are mounted from excessive wear.

Another object of the invention is to provide a protective accessory for cutting bit holding blocks which is free to rotate with respect to the shank of the cutting bit.

Another object of the invention is to provide a protective accessory for cutting bit holding blocks which is limited in axial movability with respect to the shank of the cutting bit.

Another object of the invention is to provide a novel and efficient method for attaching a generally annular-shaped protective accessory for cutting bit holding blocks to the shank of the cutting bit.

Another object of the invention is to provide an apparatus for fastening annular-shaped objects to cylindrical shanks.

Various other objects and advantages of the present invention, and its most novel features, will become apparent to those skilled in the art by perusing the accompanying specification, drawings and claims.

It is to be understood that although the invention disclosed herein if fully capable of achieving the objects and providing the advantages described, the characteristics of the invention described herein are merely illustrative of the preferred embodiment. Accordingly, I do not intent that the scope of my exclusive rights and privileges in the invention be limited to details of the embodiment described. I do intend that reasonable equivalents, adaptations and modifications of the invention described herein be included within the scope of the invention as defined by the appended claims.

SUMMARY OF THE INVENTION

Briefly stated, the present invention comprehends an accessory for use with cylindrical cutting bits which protects the holding block in which the cutting bit is mounted from excessive wear. The accessory has initially the shape of an inverted dish-shaped annular ring with a centrally located hole through the ring. The diameter of the hole is larger than the diameter of the shank of the cutting bit which it is desired to attach the accessory to.

The invention includes a novel cutting bit accessory and a novel method of attaching it to the shank of a cylindrical cutting bit. The invention is specifically adapted to attachment to cutting bits having opposed, annular flanges of larger diameter than the diameter of the shank of the cutting bit, the flanges being positioned approximately midway along the length of the cutting bit and forming an annular groove of approximately the same diameter as the shank between adjacent, inner faces of the flanges.

To attach the ring-shaped cutting bit accessory to the shank of the cutting bit, the ring is slid down over the upper end of the shank of the cutting bit until the inner circumferential surface of the central hole in the ring lies in the plane of the groove between the two annular flanges on the shank of the cutting bit. The diameter of the ring hole is slightly larger than the maximum outer diameter of the annular flanges, permitting it to slip over either flange.

Further downward movement of the accessory is prevented by contact with the upper transverse surface of a lower cylindrical die in which the cutting bit is mounted for installation of the accessory.

An upper cylindrical die with an inner diameter larger than the outer diameter of the flange, but smaller than the outer diameter of the ring-shaped accessory, is then positioned coaxially above the accessory. Finally, upper and lower cylindrical dies are moved axially together in a rapid, hammering motion against the upper and lower surfaces, respectively of the accessory. The compressive pressure exerted on the annular faces of the accessory causes it to deform into a flatter, more disc-shaped structure. This deformation of the accessory causes the central hole in the accesory to shrink to a diameter less than the outer diameter of the flanges on the cutting bit shank, but greater than the diameter of the shank. Thus, the accessory is captured axially between the inner facing surfaces of the flanges, but is free to rotate with respect to the shank.

DETAILED DESCRIPTION OF THE INVENTION

Figure 1:
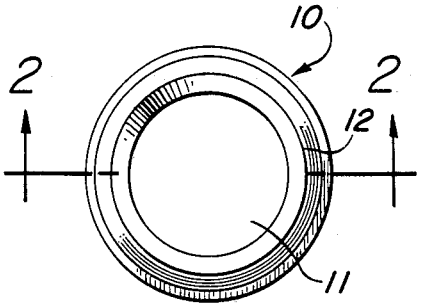
FIG. 1 is a top plan view of the cutting bit shield according to the present invention.
Figure 2:
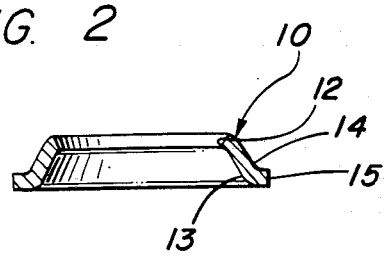
FIG. 2 is a sectional elevation view taken along line 2—2 of the device of FIG. 1 prior to its attachment to a cutting bit.

Referring now to FIGS. 1 and 2, the cutting bit accessory 10 according to the present invention is shown. Accessory 10 has generally in plan view the shape of an annular ring or washer with a hole 11 concentric with the outer circumferential surface of the ring. Hole 11 is disposed perpendicularly through the center of the ring.

As may be seen best by referring to FIG. 2, accessory 10 has in elevation view the appearance of an inverted dish having a flat upper surface 12, a concave lower surface 13, and downwardly sloping, convexly curved sides 14. As shown in FIG. 2, hole 11 through upper surface 12 of accessory 10 is countersunk at an angle of approximately 25 degrees through the entire thickness of the accessory. Accessory 10 is preferably fabricated of hot roller, 9 gauge steel which has been pickled and oiled. Preferably, accessory 10 is carburized to a depth of 1/32" minimum, and has a Rockwell hardness of about 55. Accessory 10 has a cylindrical outer surface 15.

Figure 3:
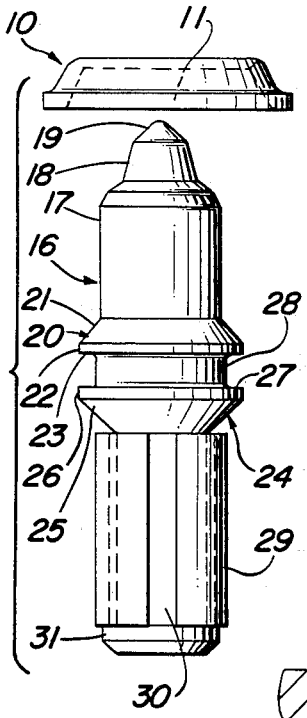
FIG. 3 is an elevation view of a cutting bit with the device of FIG. 1 being placed on the cutting bit as the first step in the process of attaching the device to the cutting bit.
Figure 7:
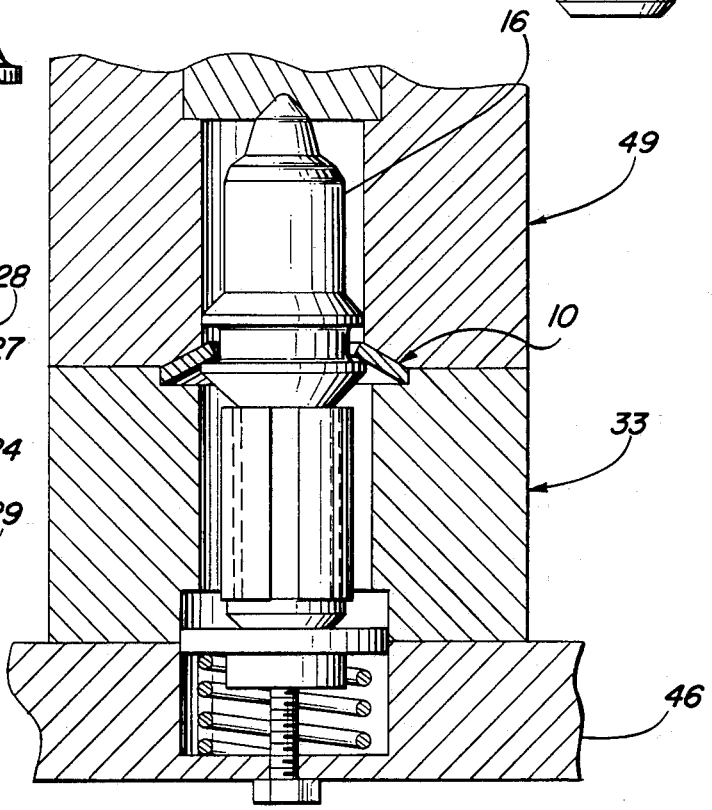
FIG. 7 is a partially sectional front elevation view of the device and apparatus shown in FIG. 4, with the upper die of the apparatus having just impacted the upper surface of the device.

A cutting bit 16 of the type which accessory 10 is adapted to be fastened to is shown in FIG. 3. Cutting bit 16 has the general appearance of an elongated cylinder with circular transverse cross-section regions of various diameters disposed along the axis of the cylinder. An upper portion of cutting bit 16 has a uniform diameter shank 17 of substantial length. Joined to the upper end of shank 17 is a conically tapered section 18, which is capped at the upper end by a conically shaped carbide cutting tip 19.

Joined to the lower end of shank 17 is a downwardly and outwardly tapered annular upper flange 20. The tapered upper surface 21 of flange 20 terminates in uniform diameter intermediate section 22 which extends a relatively short axial distance back from tapered surface 21. The lower edge of uniform diameter section 22 terminates in a transversely disposed lower annular wall 23 joined at its lower circumferential base to shank 17.

Spaced back some distance from rear transverse wall 23 of upper flange 20 is a lower flange 24 which is a mirror image of upper flange 20. Lower flange 24 has a tapered lower surface 25, which tapers downwardly and inwardly, a uniform diameter intermediate section 26, and an upper transverse annular wall 27 which are the mirror images of the corresponding elements of upper flange 20.

Upper transverse wall 27 of lower flange 24 is spaced axially rearward from rear transverse wall 23 of upper flange 20. This construction forms an annular groove 28 between upper and lower flanges. The inner circumferential base of groove 28 is formed by the outer circumferential surface of shank 17.

Below lower flange 24, a longitudinally split, cylindrical sleeve spring 29 fits over lower shank portion 30 of cutting bit 16. Sleeve spring 29 is retained in place on lower shank portion 30 by an enlarged diameter cylindrical boss section 31 capping the bottom end of lower shank portion 30. Sleeve spring 29 is used to rotatably install lower shank portion 30 of cutting bit 16 into the bore of a cutting bit holding block.

FIG. 3 shows accessory 10 having just been placed on shank 17 of cutting bit 16. The diameter of countersunk hole 11 has a minimum value at the bottom face of accessory 10. That diameter is approximately one ten-thousandth of an inch (0.010 inch) larger than the diameter of uniform diameter intermediate section 22 of upper flange 20. Thus, as shown in FIG. 4, accessory 10 may be slid coaxially downward over upper flange 17.

Figure 4:
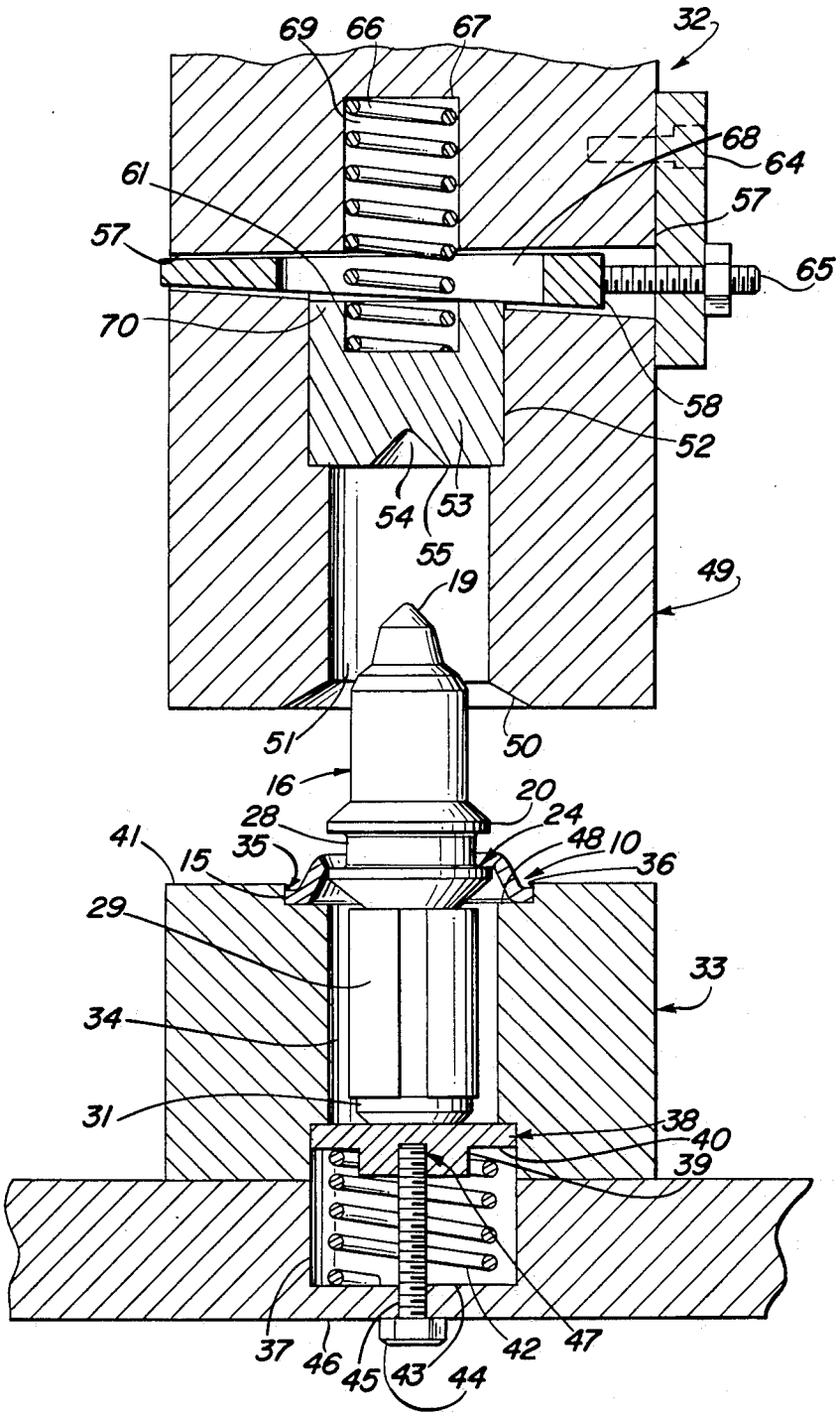
FIG. 4 is a partially sectional front elevation view of the device of FIG. 1 and the cutting bit of FIG. 3 in place in the apparatus according to the present invention used to attach the device to a cutting bit.

Also shown in FIG. 4 is an apparatus 32 for installing accessory 10 on cutting bit 16. Apparatus 32 includes a lower holding die 33 for retaining cutting bit 16 and accessory 10 in the proper position during the novel process whereby accessory 10 may be attached to cutting bit 16, as will be described below. Lower holding die 33 includes a block of tool steel having a cylindrical cavity 34 extending perpendicularly inward into the block from the upper face of the block. The diameter of cavity 34 is sufficiently large to clear the outer diameter of enlarged diameter cylindrical boss section 31 of cutting bit 16. The upper entrance 35 to cavity 34 is counterbored to a diameter slightly greater than that of cylindrical outer surface 15 of accessory 10. Preferably, the inner diameter of upper counterbore 36 is approximately five-thousands of an inch larger than the outer diameter of cylindrical outer surface 15.

Lower holding die 33 also has an enlarged diameter, lower counterbore 37. A cylindrical ejection pad 38 having a slightly smaller outer diameter than the inner diameter lower counterbore 37 fits coaxially within lower bore 37, and is movable up and down therewithin. Ejection pad 38 has a coaxial boss 39 of smaller diameter projecting downwards from the larger diameter, disc-shaped upper section 40 of the ejection pad.

Ejection pad 38 rests on the upper surface of compression spring 42, while the bottom surface of the spring rests on the floor 43 of blind cylindrical cavity 34. A screw 44 passing upward through clearance hole 45 in base 46 of lower holding die 33 is threaded into threaded hole 47 coaxially disposed upwards from the bottom face of boss 39 of ejection pad 38. Thus, by adjusting screw 44, the height of the upper face of ejection pad 38 in lower counter bore 37 may be controlled.

As shown in FIG. 4, accessory 10 is slid coaxially downwards over upper flange 20 of cutting bit 16, downward until the lower face of accessory 10 abuts the lower face 48 of upper counterbore 36 in lower holding die 33. In this position, the upper and lower entrances to cylindrical hole 11 in accessory 10 lie axially within annular groove 28 between upper flange 20 and lower flange 24.

As shown in FIG. 4, apparatus 32 for fastening accessory 10 to cutting bit 16 includes upper die shoe 49. Upper die shoe 49 includes a block of tool steel having a concave lower face 50 and a coaxially disposed blind cavity 51 extending perpendicularly inward into the block from lower face 45. Upper die shoe 49 has an upper counterbore 52. Fitted coaxially within upper counterbore 52 is an elongated cylindrical top plug 53. A conically-shaped depression 54 in the lower face 55 of cylindrical top plug 53 and coaxial therewith is of the proper size and shape to conformally receive conically-shaped carbide cutting tip 19 forming the apex of cutting bit 16.

Figure 6:
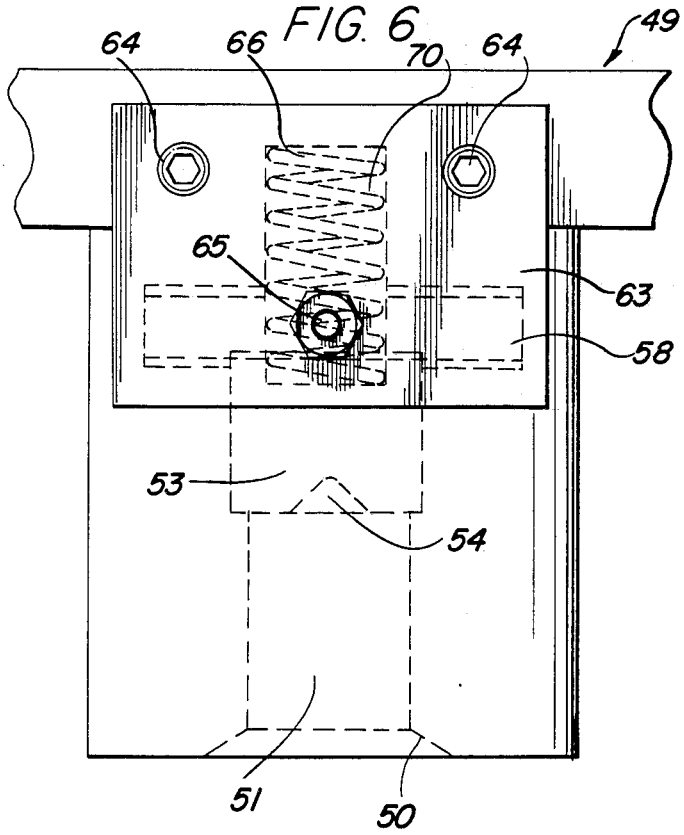
FIG. 6 is a fragmentary side elevation view of the apparatus of FIG. 4.
Figure 5:
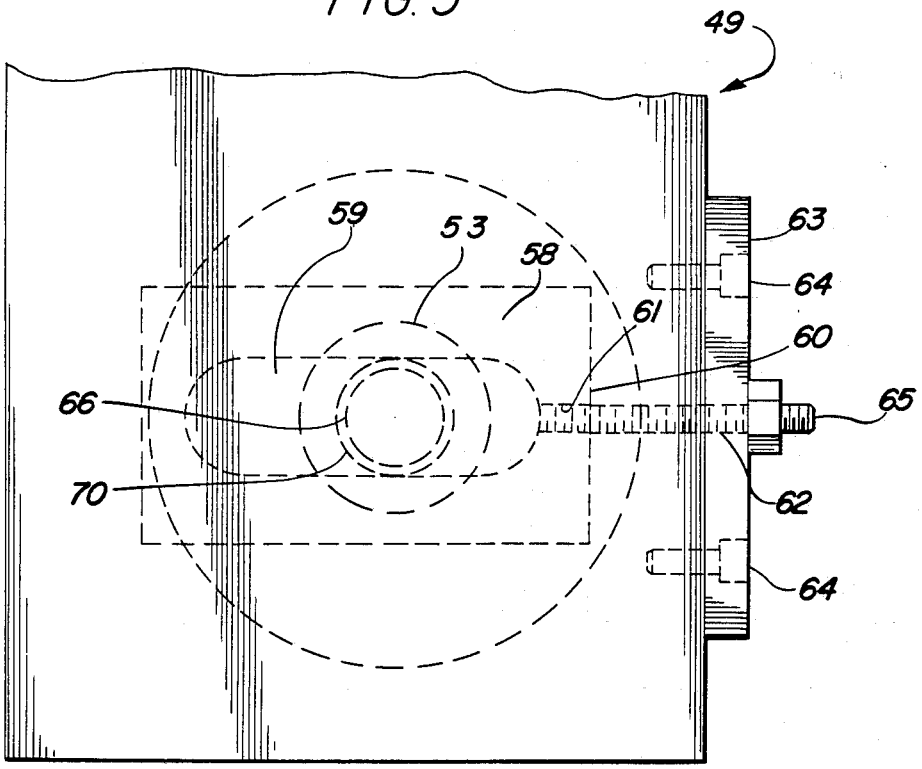
FIG. 5 is a fragmentary top plan view of the apparatus of FIG. 4.

As may be seen best in FIGS. 4, 5 and 6, a wedge-shaped slot 57 extends transversely through opposite side walls of upper die shoe 49 and through the cylindrical walls of upper counterbore 52.

A metal wedge 58 is disposed transversely through slot 57, above the top surface of cylindrical plug 53. Wedge 58 has a generally rectangular plan-view cross-sectional shape, and has an elongated rectangular hole 59 cut through the thickness dimension of the wedge. Hole 59 is disposed symmetrically along the longitudinal center line of wedge 58.

As may be seen best by referring to FIG. 4, the cross-sectional shape of wedge 58 in front elevation is that of a trapezoid having parallel vertical faces. Extending perpendicularly inwards from the longer, right hand face 60 of wedge 58 is a threaded hole 61. Hole 61 is in axial alignment with threaded hole 62 through wedge adjustment mounting plate 63 mounted on the right face of upper die shoe 49 by means of screws 64. A threaded rod 65 screwed into threaded hole 61 in wedge 58 and into threaded hole 62 in wedge adjustment mounting plate 63 may be turned to move wedge 58 radially inward or outward within slot 57. Since the lower surface of wedge 58 contacts the top surface 68 of cylindrical plug 53, radial inward or outward motion of tapered wedge 58 permits cylindrical plug 53 to move a lesser or greater distance respectively, upwards within upper counterbore 52. Thus the axial position of cylindrical plug 53 may be adjusted to accommodate cutting bits of various shank lengths. Nut 71 is tightened down on mounting plate 63 to secure threaded rod 65 at the desired position.

A compression spring 66 is disposed axially between lower face 67 of counterbore 69 in upper die shoe 49, and the upper face 68 of cylindrical top plug 53. The lower end of compression spring 66 fits into blind cylindrical cavity 70 in top plug 53. The elastic force exerted by compressed compression spring 66 resiliently maintains the lower face 55 of cylindrical top plug 53 at a desired height relative to lower concave face 50 of upper die shoe 49.

Apparatus 32 is used to fasten accessory 10 to cutting bit 16 as follows. First, a cutting bit 16 and accessory 10 are placed in position in lower holding die 33 as shown in FIG. 4. The height of ejection pad 38 is adjusted by screw 44 to that position which places cylindrical hole 11 of accessory 10 coaxially over annular groove 28 between upper flange 20 and lower flange 24 of cutting bit 16. This positions the transverse mid plane of hole 11 axially between upper and lower facing transverse flange walls 23 and 27.

Next, upper die shoe 49 is driven rapidly downwards towards lower die 33 by the action of a pneumatic or hydraulic cylinder, a cam and follower, or other actuation means, resulting in axial relative motion of upper and lower dies.

When upper die shoe 49 moves downwards towards lower die 33 containing cutting bit 16 and accessory 10, conical depression 54 in lower face 55 of cylindrical top plug 53 in upper die shoe 49 slides over conically-shaped cutting tip 19 of cutting bit 16. Since cutting tip 19 is mounted coaxially with shank 17 of cutting bit 16 conformal engagement of tip 19 by conical depression 54 forces shank 17 into coaxial alignment with blind cylindrical cavity 34 in lower holding die 33.

Further downward movement of upper die shoe 49 relative to lower die 33 causes downward movement of bit 16 relative to lower die 33, compressing spring 42. As upper die shoe 49 continues downward, cylindrical top plug 53 moves resiliently upward, further compressing spring 66. Upward motion of plug 53 relative to upper die shoe 49 is limited by wedge 58. Continued downward movement of upper die shoe 49 causes concave lower face 50 of upper die shoe 49 to forcibly contact the outer annular region of convex upper sides 14 of accessory 10. Since the lower surface of accessory 10 abuts lower face 48 of upper counterbore 37, the forcible contact exerted by upper die shoe 49 on the outer annular region of convex sides 14 of the accessory causes the accessory to deform compressively to a more nearly flat, ring-shaped disc. This is shown in FIGS. 5 and 6.

The flattening of accessory 10 causes metal of which it is composed to flow radially inward from the outer annular region of convex sides 14 of the accessory. The radially inward flow results in a substantial reduction in the maximum diameter of hole 11 through the accessory. In a typical example, the original outer diameter of accessory 10 is 1.875", the diameter of hole 11 is 1.070", and the height of the accessory is 0.500". After compressive deformation, the outer diameter of accessory 10 is still 1.875", but the diameter of hole 11 is reduced from 1.070" to 0.890", and the height of the accessory is reduced from 0.500" to 0.250".

Figure 8:
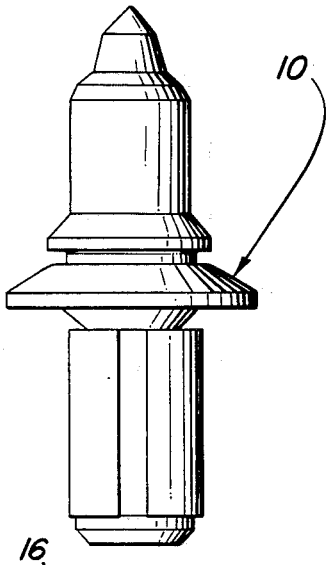
FIG. 8 is an elevation view of the device of FIG. 1 attached to a cutting bit after having been impacted by the upper die of the apparatus shown in FIG. 7.

Since in this example, the maximum diameter of upper and lower flanges 20 and 24 is 1.060", reducing the diameter of hole 11 from 1.070" to 0.890" securely captivates accessory 10 between flanges 20 and 24, as shown in FIG. 8. Thus, the present invention provides not only a novel and effective accessory 10 for protecting cutting bit holding blocks, but also provides a novel and efficient apparatus 32 and process for fastening the accessory to the shanks of cutting bits.

What is claimed is:

1. A shield adapted to fit coaxially and rotatably over the shank of a cylindrical cutting bit of the type having adjacent annular flanges and an annular groove therebetween, said shield comprising a disk-shaped circular disc made of a hard malleable metal of relatively uniform thickness, said disc having a convex upper surface, a concave lower surface, and having a central coaxialy hole disposed perpendicularly to the upper and lower surface of said disc through the thickness dimension of said disc, thereby producing an annular ring having the shape of an inverted dish, the diameter of said central hole in said ring being sufficiently larger than said shank of said cutting bit to permit free axial movement of said annular ring on said shank.

2. The article of claim 1 wherein said annular ring has a central flat annular region and downwardly sloping sides.

3. The article of claim 2 wherein said central coaxial hole of said annular ring is sufficiently large in diameter to permit said ring to slide freely and axially over the outer circumferential surface of at least one of said annular flanges on said cylindrical cutting bit.

4. The article of claim 3 wherein said annular ring is collapsible into a more generally flat structure by impacting forces applied simultaneously to said upper and lower surfaces of said annular ring, thereby reducing the diameter of said central hole to a value less than the diameter of the outer circumferential surface of either of said flanges, and thereby confining said annular ring axially between said flanges.

5. A generally cylindrical cutting bit having:

(a) an elongated circular cross-section shank, (b) a first, upper coaxial annular flange extension of said shank, (c) a second, lower coaxial annular flange extension of said shank, (d) an annular groove axially disposed between facing transverse surfaces of said first and second flanges, and (e) an annular ring made of a hard malleable metal and having a convex upper surface and a concave lower surface, said ring having a central hole perpendicular to the upper surface of said ring through the thickness dimension of said ring, the diameter of said hole being larger than the diameter of said annular groove and smaller than the outer diameter of either of said first and second annular flanges, said ring being confined coaxially in said groove between facing surfaces of said first and second flanges.

* * * * *